US005127386A

United States Patent [19]

Sowards

[11] Patent Number: 5,127,386

[45] Date of Patent: Jul. 7, 1992

[54] APPARATUS FOR CONTROLLING A SUPERCHARGER

[75] Inventor: Brian D. Sowards, Mocksville, N.C.

[73] Assignee: Ingersoll-Rand Company, Woodcliff Lake, N.J.

[21] Appl. No.: 531,615

[22] Filed: Jun. 1, 1990

[51] Int. Cl.[5] ..... F02B 33/36; F02D 23/00

[52] U.S. Cl. ..... 123/564; 417/310; 418/201.2

[58] Field of Search ..... 60/609; 123/559.1, 564; 417/310; 418/201.2

[56] References Cited

U.S. PATENT DOCUMENTS

| | | | |
|---|---|---|---|
| 2,292,233 | 8/1942 | Lysholm | 123/559.1 |
| 2,519,913 | 8/1950 | Lysholm | 418/201.2 |
| 4,498,849 | 2/1985 | Schibbye et al. | 417/310 X |
| 4,727,847 | 3/1988 | Takeda et al. | 123/564 |
| 4,826,412 | 5/1989 | Kubo et al. | 123/564 X |

FOREIGN PATENT DOCUMENTS

| | | | |
|---|---|---|---|
| 3721522 | 2/1988 | Fed. Rep. of Germany | 123/564 |
| 38614 | 2/1988 | Japan | 123/564 |
| 1300170 | 3/1987 | U.S.S.R. | 123/564 |

*Primary Examiner*—Michael Koczo
*Attorney, Agent, or Firm*—Glenn B. Foster

[57] ABSTRACT

An apparatus includes a compressor having a rotor portion, an inlet and a discharge. A motor portion of the apparatus has an intake manifold connected to the discharge. A throttle is displaceable between an open and a closed position for controlling fluid flow between the discharge and the intake manifold. A bypass return line connects the rotor portion of the compressor to the inlet. A piston valve, movable between an open location and a closed location, controls flow through the bypass return line. A control line, connecting the intake manifold to the piston valve, controls the location of the piston valve. A control valve may be included to control fluid flow through the control line. A computer, which is affected by the operation of the motor, controls the position of the control valve.

15 Claims, 1 Drawing Sheet

APPARATUS FOR CONTROLLING A SUPERCHARGER

BACKGROUND OF THE INVENTION

This invention relates generally to a supercharger, and more particularly to a control apparatus to control air flow through a supercharger compressor.

In one present supercharger system utilizing a blower, the air from the blower discharge is connected back to the inlet of the blower through a valve. When the valve is shut, the blower supercharges the engine. When the valve is open, the blower recirculates air without generating pressure. This is especially applicable to blower systems where there is no built in compression ratio, as compared to compressor supercharger systems where there is built in compression ratio in the compressor itself.

A compressor with a built in compression ratio will draw air into the working chamber, then compress the air by reduction of volume of the working chamber before the compressed air is brought to the discharge opening. Compressors without a built in compression ratio draw air into a working chamber, then open the working chamber to the discharge opening, resulting in high pressure air flowing through the discharge opening in the reverse direction compressing the air in the working chamber. Compressors with built in compression ratios are generally more efficient.

A Roots blower is an example of a compressor without a built in ratio. A twin screw compressor is an example of a compressor with a built in ratio. It is well known that plug valves used in twin screw compressors will relieve the pressure in the working chamber during unloaded operation, which reduces compressor power. These valves generally are actuated by the compressor discharge pressure which is above atmospheric pressure.

In a supercharger application, however, compressor discharge pressure alternates between above and below atmospheric pressure. Therefore, a way to control the supercharger under various engine demands must be found.

The foregoing illustrates limitations known to exist in present supercharger systems. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing an apparatus comprising a compressor having a rotor portion, an inlet and a discharge. A motor portion of the apparatus has an intake manifold connected to the discharge. A throttle is displaceable between an open and a closed position for controlling fluid flow between the discharge and the intake manifold. A bypass return line connects the rotor portion of the compressor to the inlet. A piston valve, movable between an open location and a closed location, controls flow through the bypass return line. A control line, connecting the intake manifold to the piston valve, controls the location of the piston valve.

The foregoing and other aspects will become apparent from the following detailed description of the invention when considered in conjunction with the accompanying drawing figures.

BRIEF DESCRIPTION OF THE DRAWING FIGURES

FIG. 1 is a partially cross sectional view illustrating an embodiment of an apparatus for controlling a supercharger of the instant invention, as installed on a motor; and FIG. 2 is a partially schematic view illustrating an alternate embodiment of an apparatus for controlling a supercharger of the instant invention.

DETAILED DESCRIPTION

Figure 1:
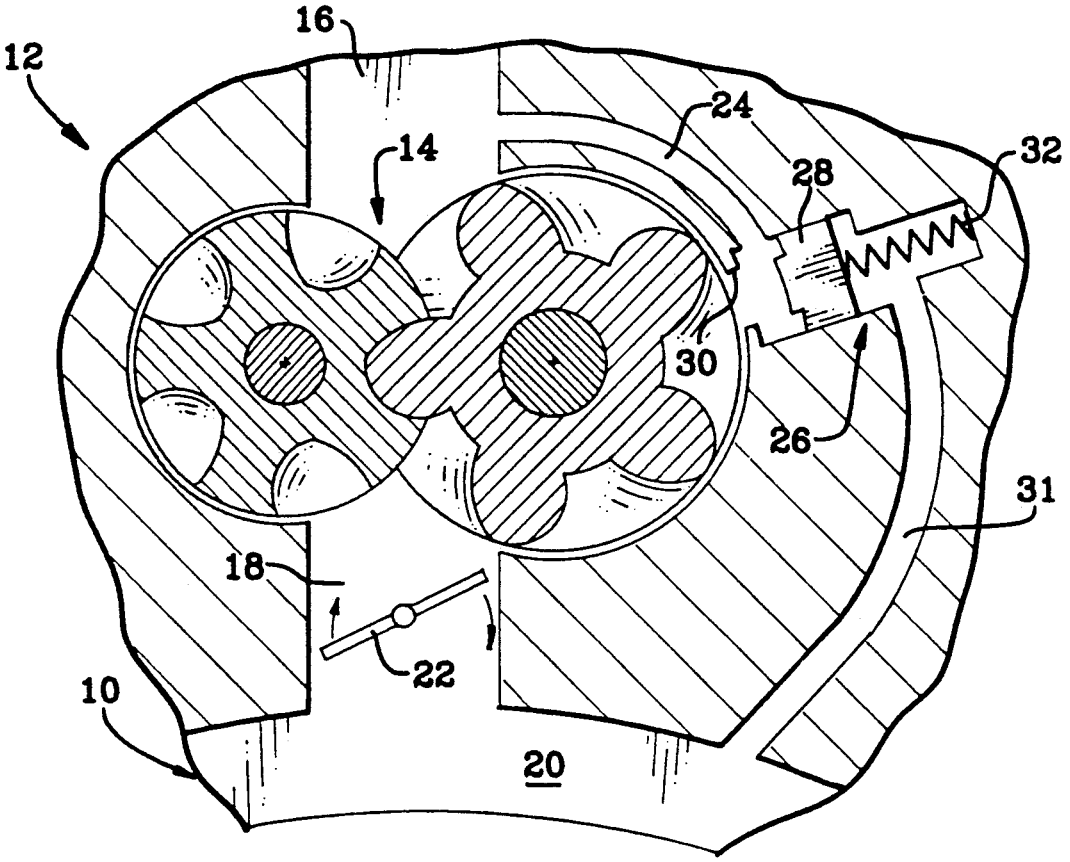

The operation of a motor or engine 10 can be enhanced by use of a compressor or supercharger 12. The compressor 12 includes a rotor portion 14 which produces the compression, an inlet 16 and a discharge 18. The compressor may be a screw type, twin parallel or any type of compressor which is well known.

The motor 10 has an intake manifold 20 where air is supplied to the motor. The discharge 18 is connected to the intake manifold 20. A throttle means 22 limits fluid flow from the discharge 18 to the intake manifold 20, and is displaceable between an open and a closed position.

A bypass return line 24 connects the rotor portion 14 to the inlet 16 of the compressor 12. The bypass return line 24 acts to vent the pressure generated by the compressor 12, and thereby reduce a built in compression ratio of the compressor.

A piston valve means 26, which may be displaced between an open and a closed location, regulates fluid flow through the bypass return line 24. In this manner, pressure in the discharge 18 may be regulated without affecting the operation of the compressor 12 itself. The location of the piston valve means depends upon pressure applied from a control line means 31 and pressure exerted by the compressor 12.

Placing the piston valve means in a closed location (piston 28 sealingly contacts sealing surface 30), restricts venting of pressure in the compressor 12 to the inlet 16. When the piston valve means is in an open location, the pressure in the compressor will be vented to the inlet.

When the throttle means 22 is in the open position, high pressure from the compressor will be applied to the intake manifold 20 and the control line 31. The high pressure in the control line 31 will tend to bias the piston valve means 26 to the closed location such that most of the pressure generated by the compressor will be diverted into the intake manifold 20, and the compressor will operate in a loaded condition.

When the throttle means is in the closed position, no pressure from the compressor will be applied to the inlet manifold or the control line 31. Pressure in the control line 31 will drop to a partial vacuum, which will cause the piston valve means 28 to be displaced to an open location.

Pressure in the compressor will thereby be vented through the bypass return line 24, and the compressor will operate in an unloaded state. This compressor unloading will prevent excess pressure from building up in the rotor portion 14 and the throttle means 22 when the throttle means 22 is closed.

A spring means 32 may also be used to assist in biasing the piston valve means 26 into the closed location.

Figure 2:
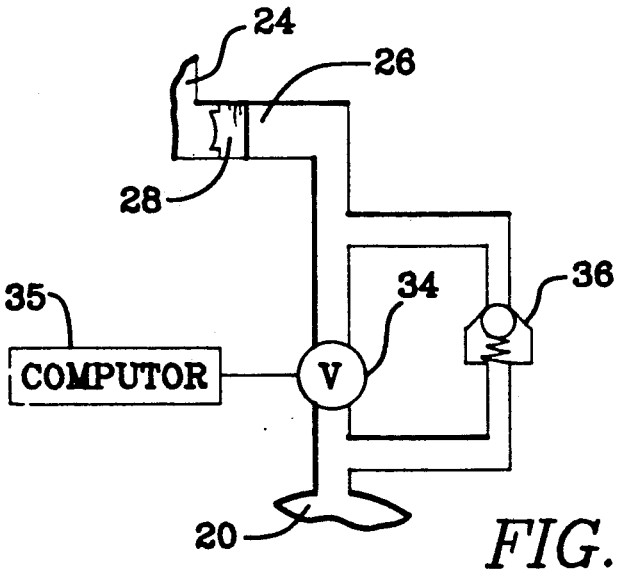

Furthermore, a control valve 34 may be inserted into the control line 31 to regulate the above operation of the control line. When there is some reason to run the supercharger compressor 12 in an unloaded condition (for example the motor 10 is still cold after starting), then the control valve will prevent passage of fluid from the intake manifold to the piston valve means. A computer 35 which controls opening of the valve 34 may be controlled from an engine computer shown on FIG. 2, for example, or other sensor.

In this configuration, any excessive pressurized fluid trapped between the control valve 34 and the piston valve means 26 will bleed out through check valve 36.

In this manner, the control line will feed from the intake manifold 20 instead of the discharge 18 of the compressor 12. This will be more reliable since the intake manifold is a more accurate indicator of operation of the motor 10.

Having described the invention, what is claimed is:

1. An apparatus comprising:

a compressor having a housing with a portion thereof adjacent a rotor, an inlet and a discharge;

a motor having an intake manifold, the intake manifold being in communication with the discharge;

throttle means, displaceable between an open and a closed position, for controlling fluid flow between the discharge and the intake manifold;

a bypass return line connecting said portion and the inlet;

a piston valve means, movable between an open location and a closed location, for controlling fluid flow through the bypass return line; and a control line means, connecting the intake manifold to the piston valve means, for controlling the location of the piston valve means.

2. The apparatus as described in claim 1, wherein the rotor includes twin screws.

3. The apparatus as described in claim 2, wherein the twin screws are parallel.

4. The apparatus as described in claim 1, wherein displacement of the throttle means into the closed position results in a partial vacuum being produced in the intake manifold and the control line means whereby the piston valve means is biased into the open location.

5. The apparatus as described in claim 1, wherein displacing the throttle means into the open position results in pressure being supplied from the rotor portion acting against the piston valve means to bias the piston valve means into the closed location.

6. The apparatus as described in claim 1, further comprising:

a control valve means, displaceable between an open and a closed valve position, for controlling fluid flow through the control line means.

7. The apparatus as described in claim 6, further comprising:

a computer means for controlling the location of the control valve means.

8. An apparatus comprising:

a compressor having a housing with a portion thereof adjacent a rotor, an inlet and a discharge, the compressor having an internal pressure;

a motor having an intake manifold, the intake manifold being connected to the discharge;

throttle means, displaceable between an open and a closed position, for controlling fluid flow between the discharge and the intake manifold;

a bypass return line means for communicating internal pressure contained within the housing portion to the inlet, the bypass return line means is connected to the portion;

a piston valve, movable between an open location and a closed location, which prevents flow in the bypass return line means when the piston valve means is in the closed location; and control line means, connecting the intake manifold to the piston valve means, for controlling the location of the piston valve means.

9. The apparatus as described in claim 8, wherein the rotor includes twin screws.

10. The apparatus as described in claim 9, wherein the twin screws are parallel.

11. The apparatus as described in claim 8, wherein displacement of the throttle means into the closed position results in a partial vacuum being produced in the intake manifold and the control line means whereby the piston valve means is biased into the open location.

12. The apparatus as described in claim 8, wherein displacing the throttle means into the open position results in pressure being supplied from the rotor portion acting against the piston valve means to bias the piston valve means into the closed location.

13. The apparatus as described in claim 8, further comprising:

a control valve means, displaceable between an open and a closed valve position, for controlling fluid flow through the control line means.

14. The apparatus as described in claim 13, further comprising:

a computer means for controlling the position of the control valve means.

15. The apparatus as described in claim 8, further comprising:

a spring means for biasing the piston valve means into the closed location.

* * * * *